US011056793B2

(12) United States Patent
Hara et al.

(10) Patent No.: US 11,056,793 B2
(45) Date of Patent: Jul. 6, 2021

(54) ANTENNA MODULE

(71) Applicant: TDK Corporation, Tokyo (JP)

(72) Inventors: Yasuyuki Hara, Tokyo (JP); Yuta Ashida, Tokyo (JP)

(73) Assignee: TDK CORPORATION, Tokyo (JP)

( * ) Notice: Subject to any disclaimer, the term of this patent is extended or adjusted under 35 U.S.C. 154(b) by 62 days.

(21) Appl. No.: 16/688,649

(22) Filed: Nov. 19, 2019

(65) Prior Publication Data

US 2020/0161767 A1 May 21, 2020

(30) Foreign Application Priority Data

Nov. 20, 2018 (JP) ..... JP2018-217000

(51) Int. Cl.
*H01Q 1/38* (2006.01)
*H01Q 9/04* (2006.01)
*H01Q 1/48* (2006.01)

(52) U.S. Cl.
CPC ..... *H01Q 9/045* (2013.01); *H01Q 1/48* (2013.01)

(58) Field of Classification Search
CPC ..... H01Q 9/045; H01Q 1/48; H01Q 1/2283; H01Q 9/0457; H01Q 21/065; H01Q 9/041
See application file for complete search history.

(56) References Cited

U.S. PATENT DOCUMENTS

2003/0020173 A1* 1/2003 Huff ..... H01P 1/184 257/774
2006/0055601 A1 3/2006 Kameda et al.

FOREIGN PATENT DOCUMENTS

JP 2004-040597 A 2/2004

* cited by examiner

*Primary Examiner* — Dieu Hien T Duong
(74) *Attorney, Agent, or Firm* — McDermott Will & Emery LLP

(57) ABSTRACT

Disclosed herein is an antenna module that includes a circuit layer having a filter circuit, an antenna layer having a radiation conductor, a wiring layer having a connection wiring, a first ground pattern provided on a surface of the circuit layer, a second ground pattern provided between the circuit layer and the wiring layer, a third ground pattern provided between the wiring layer and the antenna layer, and a signal terminal provided on the surface of the circuit layer where the first ground pattern is cut away. The clearance region is located so as not to overlap the filter circuit as viewed in a lamination direction. The signal terminal is connected to the filter circuit through a pillar conductor penetrating the circuit layer and the connection wiring. The radiation conductor receives power through a feed pattern connected to the filter circuit.

18 Claims, 9 Drawing Sheets

ANTENNA MODULE

BACKGROUND OF THE INVENTION

Field of the Invention

The present invention relates to an antenna module and, more particularly, to an antenna module integrally having an antenna layer including a radiation conductor and a circuit layer including a filter circuit.

Description of Related Art

As an antenna module integrally having an antenna layer including a radiation conductor and a circuit layer including a filter circuit, an antenna module described in JP 2004-040597 A is known. In the antenna module described in JP 2004-040597 A, the antenna layer and the circuit layer are laminated with a ground pattern interposed therebetween to prevent mutual interference between the antenna layer and the circuit layer. Further, in this antenna module, the ground pattern is provided on the bottom surface of the circuit layer, and a signal terminal is provided in a clearance region where the ground pattern is cut away.

When such an antenna module is mounted on a print board, a strong stress is sometimes generated in a solder ball connecting the antenna module and the printed circuit board due to a difference in thermal expansion coefficient therebetween. The stress resulting from a difference in thermal expansion coefficient becomes particularly noticeable when the planar size of the antenna module is increased by arraying the antenna modules. In order to solve this problem, it is necessary to increase the size of the solder ball to some extent so as to prevent the signal terminal from peeling off from the printed circuit board even when the stress is applied to the solder ball.

In order to increase the size of the solder ball, it is necessary to increase the size of the clearance region of the ground pattern. For example, as illustrated in FIG. 14, when a circuit layer 10 is provided between ground patterns G1 and G2, and a signal terminal SP is disposed immediately below a filter circuit 12 included in the circuit layer 10, the size of a clearance region CL may be small when the size of the signal terminal SP is small to a certain degree. However, when only a solder ball B is increased in size in the illustrated design, a solder ball B' and the ground pattern G1 interfere with each other. To avoid such interference, it is necessary to increase the size of the signal terminal SP as illustrated in FIG. 15. However, in this case, a large clearance region CL is formed immediately below the filter circuit 12, so that leakage of an electromagnetic field from the filter circuit 12 becomes noticeable to significantly affect the characteristics of rear-stage circuits mounted on a printed circuit board.

On the other hand, as illustrated in FIG. 16, when another ground pattern G0 is provided between the filter circuit 12 and the ground pattern G1 and a clearance region CL0 formed in the ground pattern G0 is designed to have a small size, the electromagnetic field leakage from the filter circuit 12 can be suppressed. However, in this case, the ground pattern G0 and the signal terminal SP overlap each other, so that a large parasitic capacitance C is generated at the overlapping portion, thus failing to achieve sufficient impedance matching.

As described above, in conventional antenna modules, it is difficult to enhance bonding strength with respect to the printed circuit board without significantly affecting circuit characteristics.

SUMMARY

It is therefore an object of the present invention to enhance bonding strength with respect to a printed circuit board without significantly affecting circuit characteristics in an antenna module in which an antenna layer and a circuit layer are laminated.

An antenna module according to the present invention includes: a circuit layer having a filter circuit; an antenna layer laminated on the circuit layer and having a radiation conductor; a wiring layer positioned between the circuit layer and the antenna layer and having a connection wiring connected to the filter circuit; a first ground pattern provided on the surface of the circuit layer located on the opposite side of the wiring layer; a second ground pattern provided between the circuit layer and the wiring layer; a third ground pattern provided between the wiring layer and the antenna layer; and a signal terminal provided on the surface of the circuit layer and positioned within a clearance region where the first ground pattern is cut away. The clearance region is formed at a position not overlapping the filter circuit as viewed in the lamination direction. The signal terminal is connected to the filter circuit through a pillar conductor penetrating the circuit layer and the connection wiring. The radiation conductor receives power through a feed pattern connected to the filter circuit.

According to the present invention, the clearance region formed in the first ground pattern does not overlap the filter circuit, so that a large part of, preferably, the entire filter circuit can be covered with the first ground pattern. This can suppress leakage of an electromagnetic field from the filter circuit. In addition, the wiring layer is disposed between the circuit layer and the antenna layer, so that a parasitic capacitance generated between the signal terminal and the second ground pattern can be reduced. Thus, according to the present invention, it is possible to increase the size of the signal terminal without significantly affecting circuit characteristics. This allows the use of a large-sized solder ball, making it possible to enhance bonding strength with respect to a printed circuit board.

In the present invention, the diameter of the clearance region may be equal to or larger than 1/10 of the wavelength of an antenna signal radiated from the radiation conductor in the circuit layer. When the clearance region is to be disposed immediately below the filter circuit and if the diameter of the clearance region is equal to or larger than 1/10, a large part of the filter circuit is exposed without being covered by the first ground pattern, with the result that the leakage of an electromagnetic field from the filter circuit becomes extremely large. However, in the present invention, the clearance region is disposed at a location not overlapping the filter circuit, so that even when the diameter of the clearance region is designed to be equal to or larger than 1/10 of the wavelength, the leakage of an electromagnetic field from the filter circuit hardly occurs.

In the present invention, the dielectric constant of the dielectric constituting the wiring layer may be lower than the dielectric constant of the dielectric constituting the circuit layer. This can reduce a parasitic capacitance generated in the connection wiring. In this case, the dielectric constant of the dielectric constituting the wiring layer may be equal to the dielectric constant of a dielectric constituting the antenna layer. This allows the wiring layer and the antenna layer to be formed using the same dielectric material.

In the present invention, the feed pattern may be electromagnetically coupled to the radiation conductor through a slot formed in the third ground pattern. This eliminates the need to provide a feed line in the antenna layer, thereby simplifying the configuration of the antenna layer. In this case, the feed pattern may be formed in the wiring layer. Thus, the feed pattern and the connection wiring can be formed in the same layer, so that the height dimension of the antenna module can be reduced.

The antenna module according to the present invention may further include a feed layer provided between the wiring layer and the antenna layer and having the feed pattern and a fourth ground pattern provided between the wiring layer and the feed layer, and the third ground pattern may be provided between the feed layer and the antenna layer. This allows the feed pattern and the connection wiring to overlap each other in a plan view. Further, since the fourth ground pattern is interposed between the feed pattern and the connection wiring, a layout in which the feed pattern and the connection wiring cross each other can be adopted.

In the present invention, the filter circuit may include a band-pass filter. This allows only an antenna signal in a specific band to pass.

In the present invention, the antenna layer may further have another radiation conductor that overlaps the radiation conductor as viewed in the lamination direction. This allows the antenna bandwidth to be further broadened.

In the antenna module according to the present invention, a plurality of radiation conductors may be arranged in an array. Thus, a so-called phased array can be constituted.

Thus, according to the present invention, it is possible to enhance bonding strength with respect to a printed circuit board without significantly affecting the circuit characteristics in an antenna module in which an antenna layer and a circuit layer are laminated.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
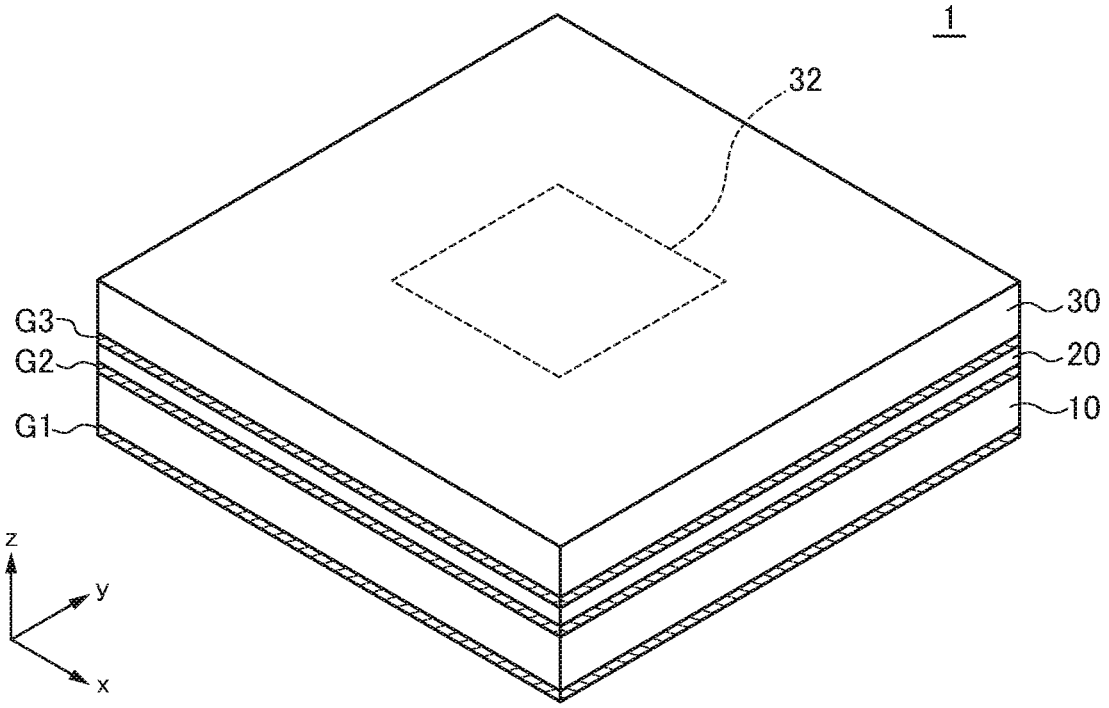
FIG. 1 is a schematic perspective view illustrating the outer appearance of an antenna module according to a first embodiment of the present invention.
Figure 2:
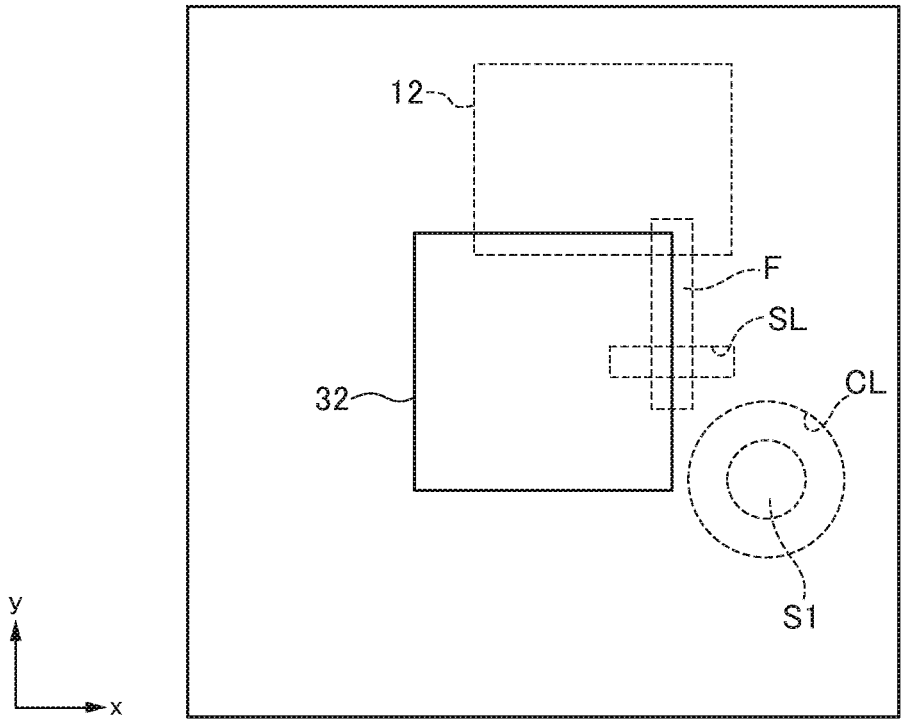
FIG. 2 is a schematic transparent plan view illustrating the antenna module according to the first embodiment of the present invention.
Figure 3:
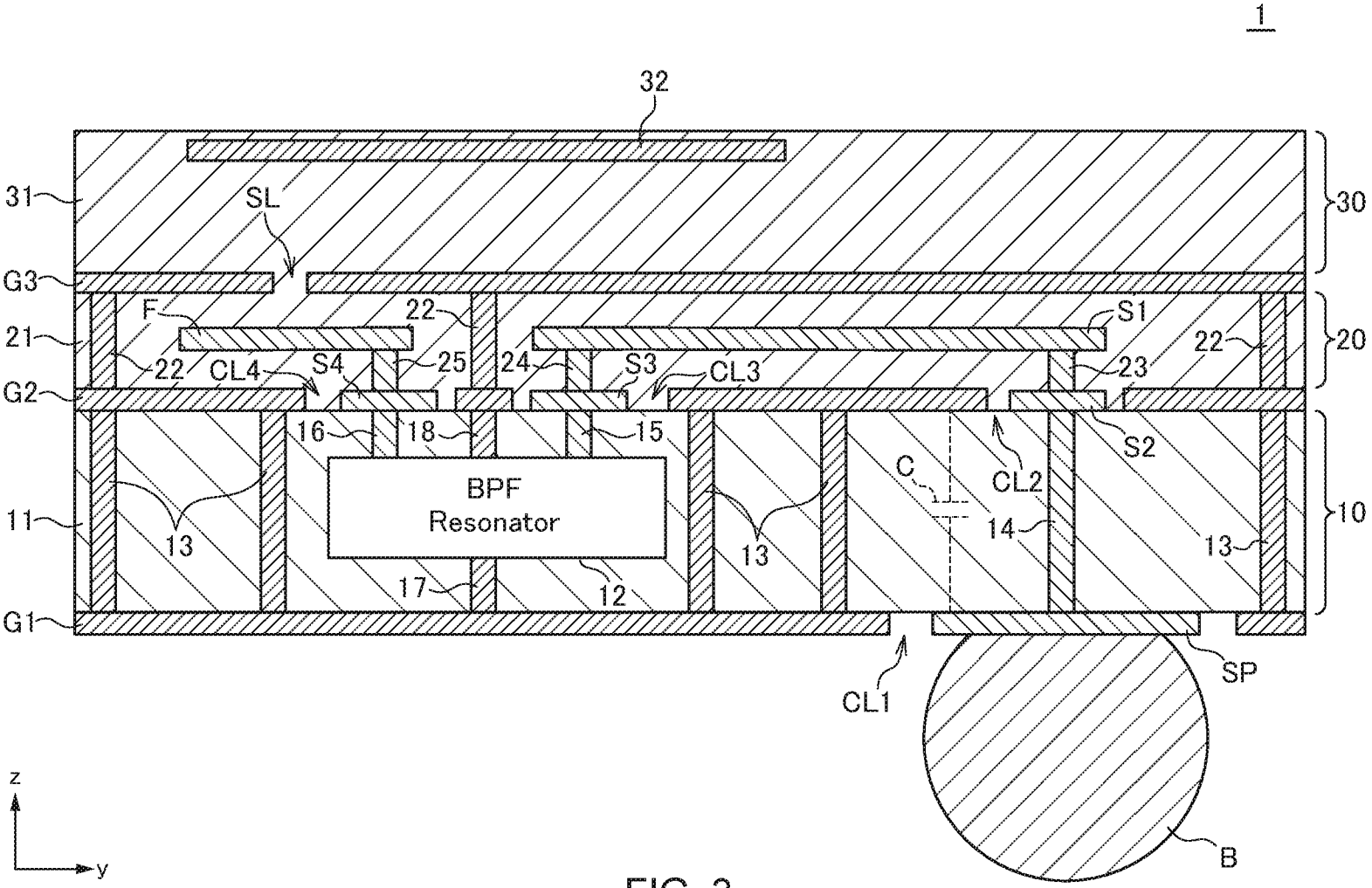
FIG. 3 is a schematic cross-sectional view illustrating the antenna module according to the first embodiment of the present invention.

FIGS. 1 to 3 are a schematic perspective view, a schematic transparent plan view and a schematic cross-sectional view, respectively, illustrating the outer appearance of an antenna module 1 according to the first embodiment of the present invention.

The antenna module 1 according to the first embodiment is a module that performs wireless communication using millimeter wavebands and includes a circuit layer 10 positioned in the lower layer, an antenna layer 30 positioned in the upper layer, and a wiring layer 20 positioned between the circuit layer 10 and the antenna layer 30, as illustrated in FIGS. 1 to 3. The circuit layer 10, wiring layer 20 and antenna layer 30 have dielectric layers 11, 21 and 31, respectively, and various conductor patterns are formed inside or on the surfaces of the dielectric layers 11, 21 and 31. The material of the dielectric layers 11, 21 and 31 may be, but is not particularly limited to, a ceramic material such as LTCC or a resin material.

In the present embodiment, some or all of the circuit layer 10, wiring layer 20 and antenna layer 30 may be formed using mutually different materials. For example, it is possible to form the circuit layer 10 using LTCC and to form the wiring layer 20 and the antenna layer 30 using resin. Particularly, when the dielectric layers 21 and 31 constituting the wiring layer 20 and the antenna layer 30, respectively, are formed using a material having a dielectric constant lower than that of a material used for forming the dielectric layer 11 constituting the circuit layer 10, high antenna characteristics can be obtained, and parasitic capacitance generated in the wiring layer 20 can be reduced. When the dielectric layers 21 and 31 constituting the wiring layer 20 and antenna layer 30, respectively, are formed using the same dielectric material, a manufacturing process can be simplified.

The circuit layer 10 is a layer in which a filter circuit such as a band-pass filter 12 is formed. The lower surface of the circuit layer 10 is covered with a ground pattern G1, and the upper surface thereof is covered with a ground pattern G2. The ground patterns G1 and G2 are short-circuited to each other by a number of pillar conductors 13 extending in the lamination direction (z-direction), whereby a ground potential is stabilized. The ground pattern G1 is formed on almost the entire lower surface of the circuit layer 10, excluding a clearance region CL1 at which a signal terminal SP is formed, to thereby function as an electromagnetic wave shield below the circuit layer 10. Particularly, the ground pattern G1 has no clearance region CL immediately below the band-pass filter 12, so that the lower surface of the band-pass filter 12 is completely covered with the ground pattern G1. The ground pattern G2 is formed on almost the entire upper surface of the circuit layer 10, excluding clearance regions CL2 to CL4, to thereby function as an electromagnetic wave shield above the circuit layer 10. Signal patterns S2 to S4 are formed on the clearance regions CL2 to CL4, respectively.

The lower surface of the wiring layer 20 is covered with the ground pattern G2, and the upper surface thereof is covered with a ground pattern G3. The ground patterns G2 and G3 are short-circuited to each other by a number of pillar conductors 22 extending in the lamination direction, whereby a ground potential is stabilized. Further, the wiring layer 20 has a connection wiring S1 embedded in the dielectric layer 21. One end of the connection wiring S1 is connected to the signal pattern S2 through a pillar conductor 23, and the other end thereof is connected to the signal pattern S3 through a pillar conductor 24.

Further, the wiring layer 20 has a feed pattern F embedded in the dielectric layer 21. The feed pattern F is a strip-shaped conductor pattern extending in the y-direction and partially overlaps a radiation conductor 32, as viewed in the z-direction, in the present embodiment. One end of the feed pattern F is connected to the signal pattern S4 through a pillar conductor 25, and the other end thereof is opened. The feed pattern F and the connection wiring S1 may be positioned in the same layer or different layers. When the feed pattern F and the connection wiring S1 are formed in the same layer, the thickness of the wiring layer 20 can be reduced.

As illustrated in FIG. 3, the signal pattern S3 is connected to one end of the band-pass filter 12 through a pillar conductor 15 provided inside the circuit layer 10. The signal pattern S4 is connected to the other end of the band-pass filter 12 through a pillar conductor 16 provided inside the circuit layer 10. Thus, the signal terminal SP is connected to one end of the band-pass filter 12 through the pillar conductor 14, signal pattern S2, pillar conductor 23, connection wiring S1, pillar conductor 24, signal pattern S3 and pillar conductor 15. The other end of the band-pass filter 12 is connected to the feed pattern F through the pillar conductor 16, signal pattern S4 and pillar conductor 25. The band-pass filter 12 is applied with a ground potential through pillar conductors 17 and 18.

The antenna layer 30 has a radiation conductor 32. The radiation conductor 32 is a rectangular conductor pattern provided at substantially the center of the antenna module 1 as viewed in the lamination direction. The radiation conductor 32 is not connected to other conductor patterns and is in a DC-floating state. The upper surface of the antenna layer 30 is opened, while the lower surface thereof is covered with the ground pattern G3. The ground pattern G3 is formed on almost the entire lower surface of the antenna layer 30, excluding a slot SL, to thereby function as a reference conductor for a patch antenna. The slot SL extends in the x-direction so as to cross the feed pattern F.

The feed pattern F is electromagnetically coupled to the radiation conductor 32 through the slot SL1. As a result, an antenna signal fed from the band-pass filter 12 to the feed pattern F is fed to the radiation conductor 32 through the slot SL1 to be radiated to a space. As described above, in the present embodiment, power is not directly fed to the radiation conductor 32 using the pillar-shaped conductor, but is fed by electromagnetic coupling through the slot SL1. This significantly simplifies the configuration of the antenna layer 30, which in turn can simplify the manufacturing process.

As described above, in the antenna module 1 according to the present embodiment, the band-pass filter 12 and the signal terminal SP are disposed at different locations in a plan view, so that the entire lower surface of the band-pass filter 12 can be covered with the ground pattern G1. This can effectively suppress leakage of an electromagnetic field from the band-pass filter 12. Further, in the present embodiment, a change in the size of the signal terminal SP does not cause a change in the characteristics of the band-pass filter 12 and a significant change in the leakage amount of an electromagnetic field, so that it is possible to increase the size of the signal terminal SP without significantly affecting the circuit characteristics. This allows the use of a large-sized solder ball B, making it possible to enhance bonding strength with respect to the printed circuit board.

Here, it is assumed that the clearance region CL is disposed immediately below the band-pass filter 12. In this case, when the diameter of the clearance region CL is equal to or larger than 1/10 of the wavelength of an antenna signal in the circuit layer 10, a large part of the band-pass filter 12 is exposed without being covered with the ground pattern G1, with the result that the leakage of an electromagnetic field from the band-pass filter 12 becomes extremely large. However, in the antenna module 1 according to the present embodiment, the clearance region CL1 is disposed at a location not overlapping the band-pass filter 12, so that even when the diameter of the clearance region CL is designed to be equal to or larger than 1/10 of the wavelength, the leakage of an electromagnetic field from the band-pass filter 12 hardly occurs.

Further, in the present embodiment, the wiring layer 20 including the connection wiring S1 is disposed between the circuit layer 10 and the antenna layer 30, so that a parasitic capacitance C generated between the signal terminal SP and the ground pattern G2 can also be reduced. This facilitates impedance matching.

Figure 4:
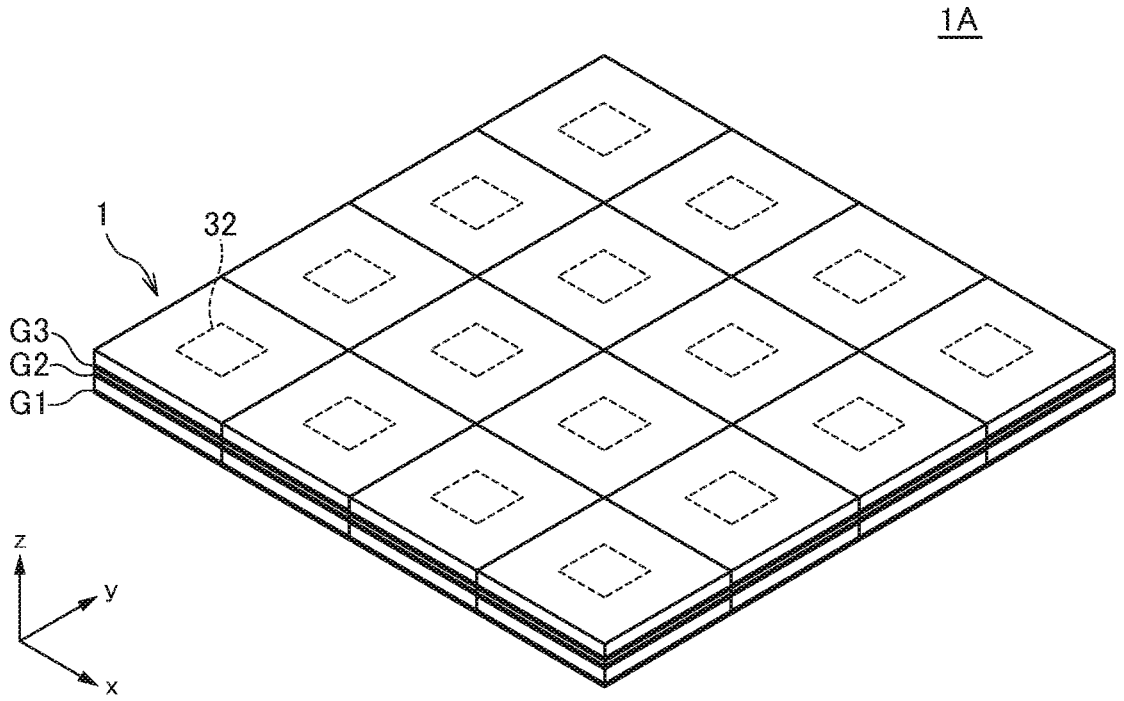
FIG. 4 is a schematic perspective view for explaining the configuration of an antenna module obtained by laying out a plurality of the antenna modules shown in FIGS. 1 to 3 in an array.

FIG. 4 is a schematic perspective view for explaining the configuration of an antenna module 1A obtained by laying out a plurality of the antenna modules 1 in an array. In the example illustrated in FIG. 4, 16 antenna modules 1 are laid out in an array in the xy plane. When the plurality of antenna modules 1 are thus laid out in an array, a so-called phased array can be constituted, allowing the beam direction to be changed as desired. Further, the antenna module 1A having the plurality of antenna modules 1 laid out in an array has a large mounting area on the printed circuit board, a strong stress is generated in the solder ball B due to a difference in thermal expansion coefficient between the antenna module 1A and the printed circuit board. However, in the present embodiment, the solder ball B can be increased in size, making it possible to prevent peeling off of the signal terminal SP due to the stress.

Second Embodiment

Figure 5:
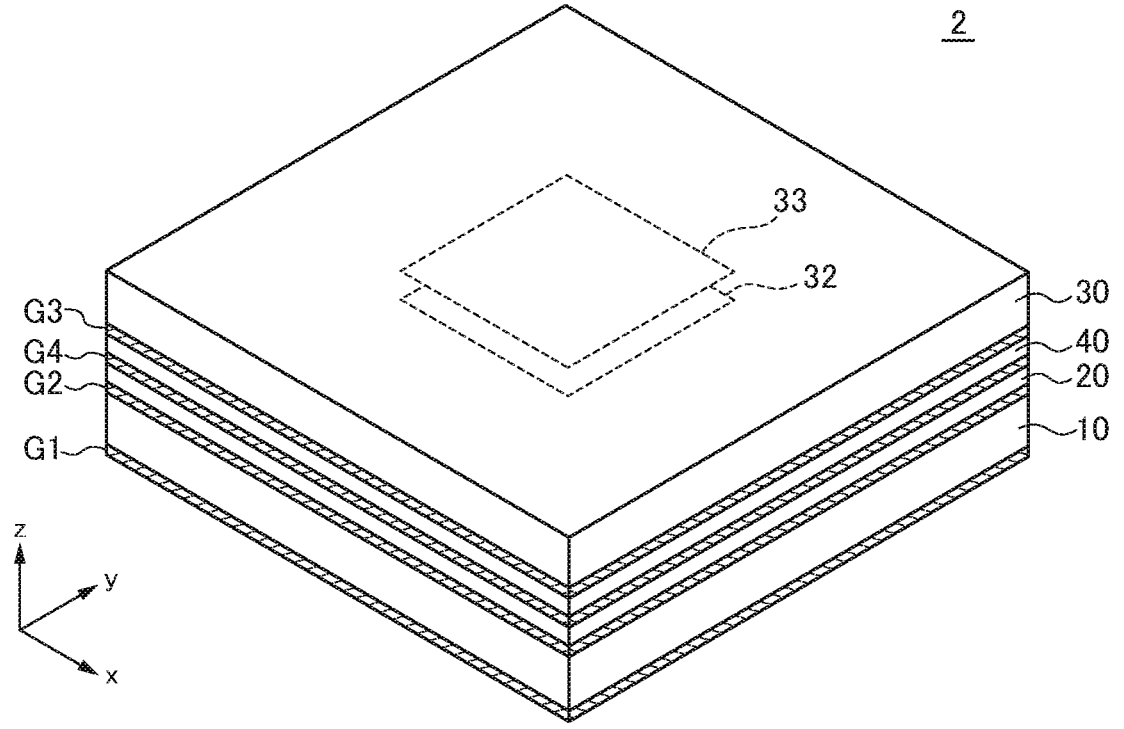
FIG. 5 is a schematic perspective view illustrating the outer appearance of an antenna module according to a second embodiment of the present invention.
Figure 6:
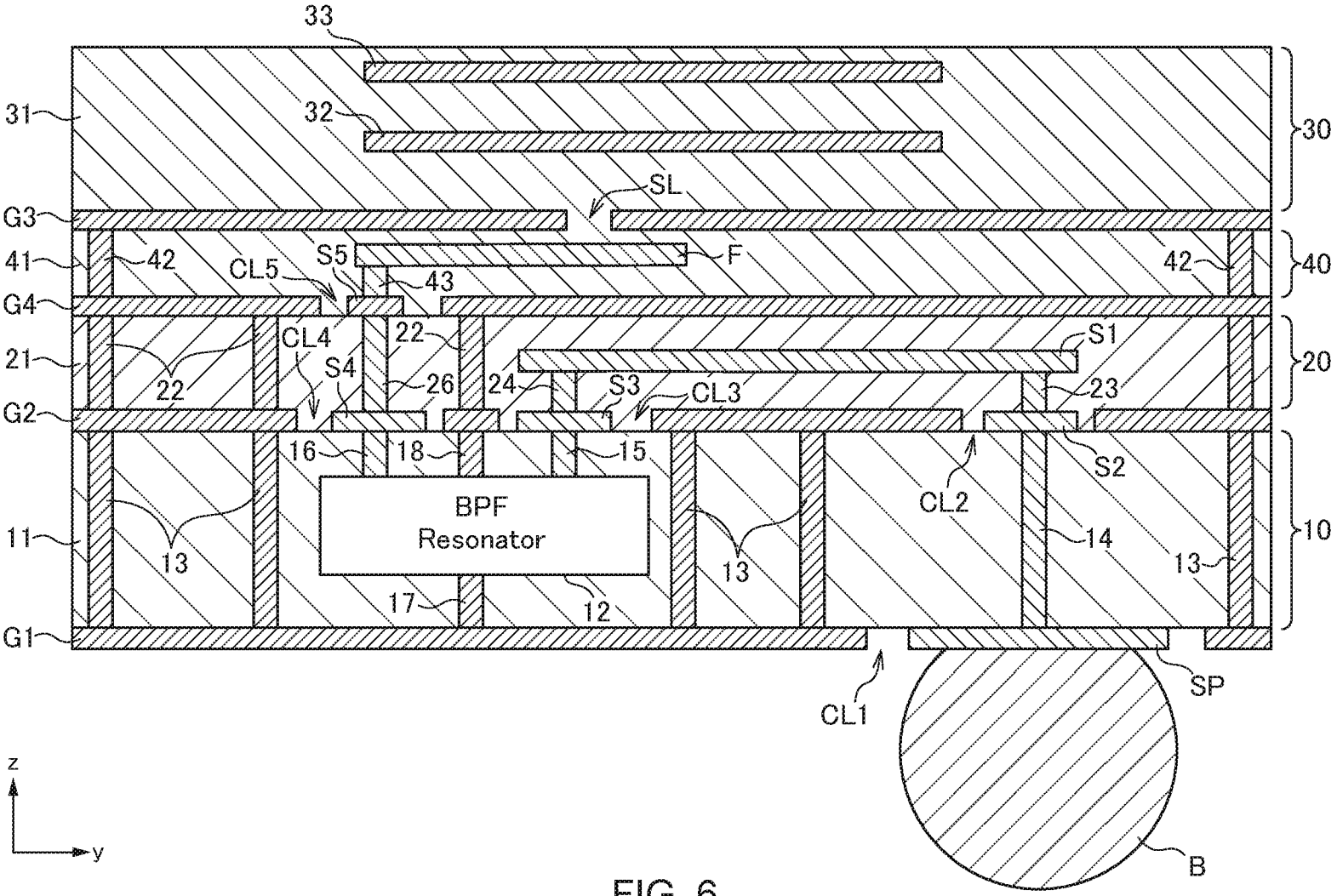
FIG. 6 is a schematic cross-sectional view illustrating the antenna module according to the second embodiment of the present invention.

FIGS. 5 and 6 are a schematic perspective view and a schematic cross-sectional view, respectively, illustrating the outer appearance of an antenna module 2 according to the second embodiment of the present invention.

As illustrated in FIGS. 5 and 6, the antenna module 2 according to the second embodiment differs from the antenna module 1 according to the first embodiment in that a feed layer 40 is added between the wiring layer 20 and the antenna layer 30 and that a ground pattern G4 is provided between the wiring layer 20 and the feed layer 40. In the present embodiment, the ground pattern G3 is provided between the feed layer 40 and the antenna layer 30. Other basic configurations are the same as those of the antenna module 1 according to the first embodiment, so the same reference numerals are given to the same elements, and overlapping description will be omitted.

The lower surface of the feed layer 40 is covered with the ground pattern G4, and the upper surface thereof is covered with the ground pattern G3. The ground patterns G4 and G3 are short-circuited to each other by a number of pillar conductors 42 extending in the lamination direction, whereby a ground potential is stabilized. In the present embodiment, the feed pattern F is provided not in the wiring layer 20, but in the feed layer 40. The feed pattern F is embedded in the dielectric layer 41 constituting the feed layer 40, and one end thereof is connected to a signal pattern S5 provided in a clearance region CL5 through a pillar conductor 43. The signal pattern S5 is connected to the signal pattern S4 through a pillar conductor 26 penetrating the wiring layer 20. As a result, an antenna signal output from the band-pass filter 12 is fed to the feed pattern F through the pillar conductor 16, signal pattern S4, pillar conductor 26, signal pattern S5 and pillar conductor 43.

Further, in the present embodiment, the antenna layer 30 has another radiation conductor 33. The radiation conductor 33 is a rectangular conductor pattern provided above the radiation conductor 32 so as to overlap the radiation conductor 32 as viewed in the z-direction. The radiation conductor 33 is not connected to other conductor patterns and is in a DC-floating state. When the plurality of radiation conductors 32 and 33 are thus formed in the antenna layer 30, antenna bandwidth can be further broadened. The size of each of the radiation conductors 32 and 33 and the distance therebetween may be adjusted as needed according to required antenna characteristics.

When the feed layer 40 is provided separately from the wiring layer 20 as in the antenna module 2 according to the present embodiment, it is possible to realize a layout in which the connection wiring S1 and the feed pattern F cross each other in a plan view, increasing the freedom of layout. In addition, the ground pattern G4 is interposed between the connection wiring S1 and the feed pattern F, so that the connection wiring S1 and the feed pattern F are not coupled even when they are made to cross each other. Thus, the antenna module 2 according to the present embodiment achieves a high degree of layout freedom, so that it is possible to easily constitute a dual-polarized antenna module by feeding power to the radiation conductor 32 from two locations.

The following describes a specific configuration of the antenna module 2 of a dual-polarized type.

Figure 7:
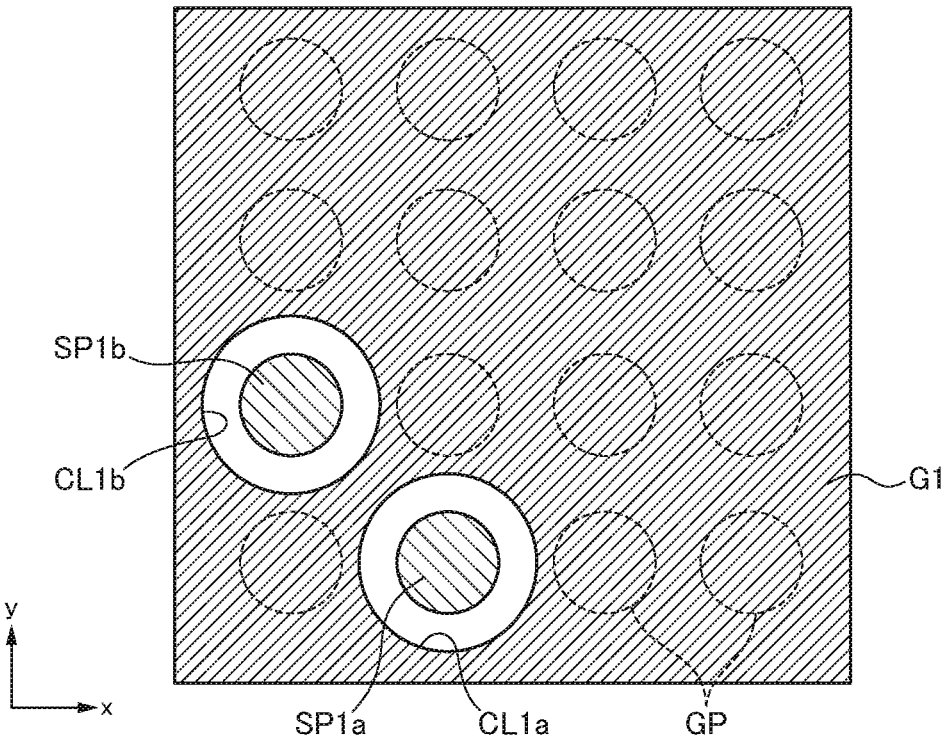
FIG. 7 is a schematic plan view illustrating the structure of the back surface of the dual-polarized antenna module.

FIG. 7 is a schematic plan view illustrating the structure of the back surface of the dual-polarized antenna module 2.

As illustrated in FIG. 7, when the antenna module 2 is configured as a dual-polarized type, two clearance regions CL1*a* and CL1*b* are formed in the ground pattern G1. A first signal terminal SP1*a* is disposed in the clearance region CL1*a*, and a second signal terminal SP1*b* is disposed in the clearance region CL1*b*. The first signal terminal SP1*a* is a terminal for transmitting/receiving, e.g., a vertical polarization signal, and the second signal terminal SP1*b* is a terminal for transmitting/receiving, e.g., a horizontal polarization signal.

The other area of the back surface is fully covered with the ground pattern G1. In actual use, a part of the ground pattern G1 is covered by a solder resist, and the exposed part thereof through the solder resist is used as a ground terminal GP. In the example illustrated in FIG. 7, 4×4 terminals are arranged in a matrix. Among them, one terminal is used as the first signal terminal SP1*a*, another terminal as the second signal terminal SP1*b* and the remaining 14 terminals each as the ground terminal GP.

Figure 8:
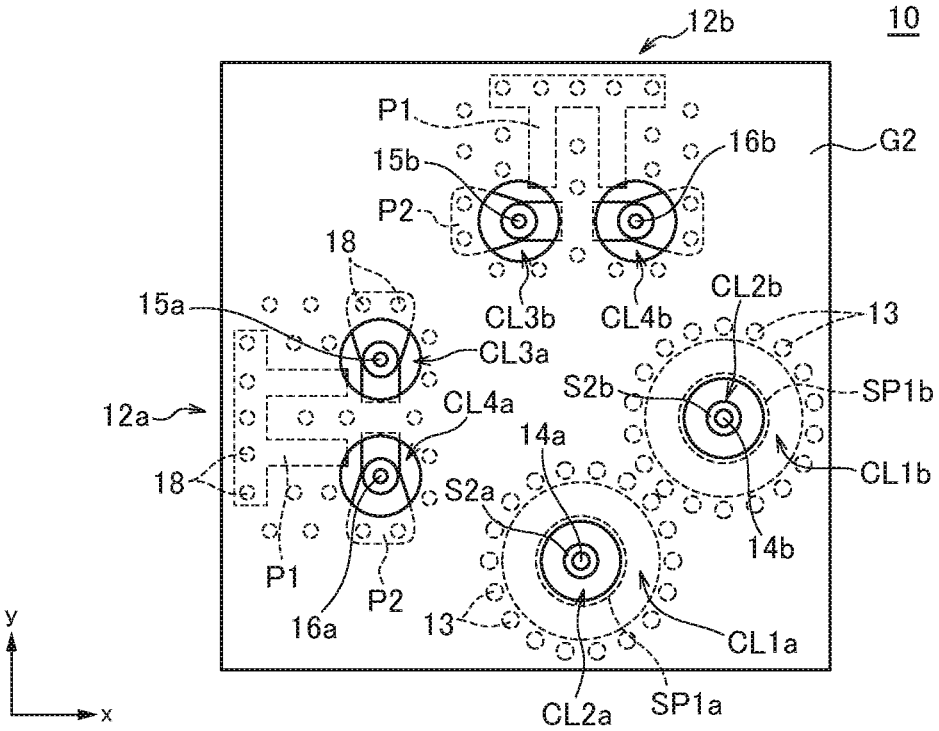
FIG. 8 is a schematic transparent plan view of the first circuit layer included in the dual-polarized antenna module as viewed from the upper surface side.
Figure 9:
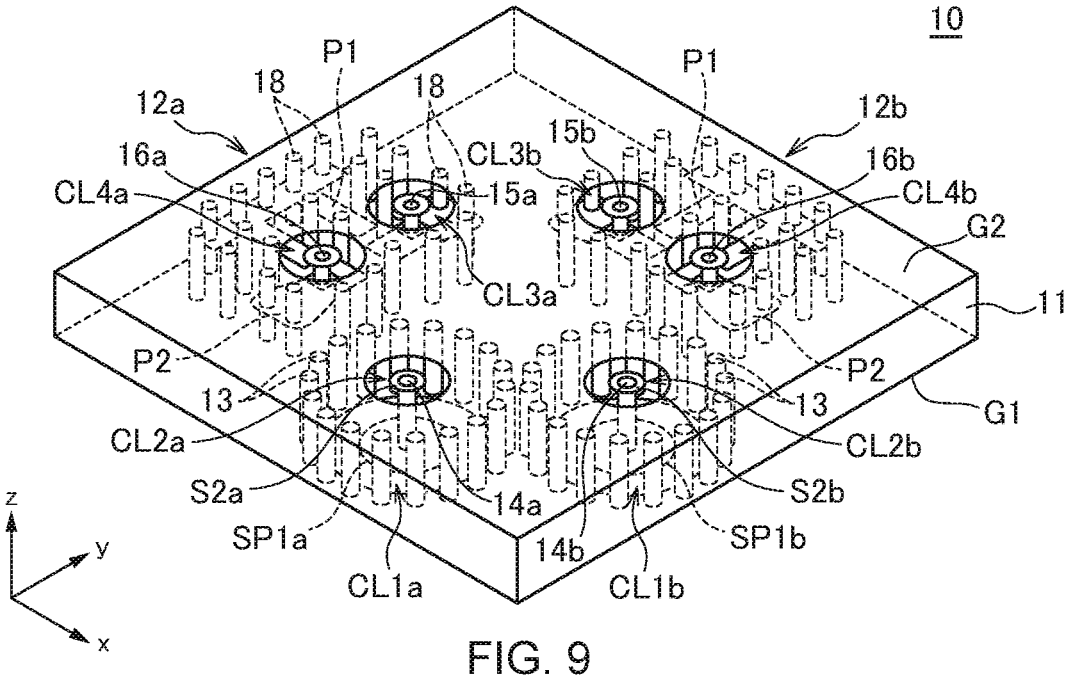
FIG. 9 is a schematic transparent perspective view of the first circuit layer included in the dual-polarized antenna module.

FIGS. 8 and 9 are a schematic transparent plan view and a schematic transparent perspective view, respectively, of the circuit layer 10 included in the dual-polarized antenna module 2 as viewed from the upper surface side.

As illustrated in FIGS. 8 and 9, the circuit layer 10 included in the dual-polarized antenna module 2 has two band-pass filters 12*a* and 12*b*. The band-pass filters 12*a* and 12*b* each have a resonance pattern P1 having a 7C shape and a resonance pattern P2 having a linear shape. A ground potential is supplied to predetermined planar positions of the respective resonance patterns P1 and P2 through a plurality of pillar conductors 17 and 18. Further, a plurality of pillar conductors 13 are disposed around each of the resonance patterns P1 and P2, whereby the ground potential is stabilized. The plurality of pillar conductors 13 are also disposed around each of the clearance regions CL1*a* and CL1*b*, whereby the ground potential is stabilized. The signal terminal SP1*a* provided in the clearance region CL1*a* is connected to a pillar conductor 14*a*, and the signal terminal SP1*b* provided in the clearance region CL1*b* is connected to a pillar conductor 14*b*. The pillar conductors 14*a* and 14*b* are connected, respectively, to signal patterns S2*a* and S2*b* disposed in the respective clearance regions CL2*a* and CL2*b*. Further, clearance regions CL3*a*, CL3*b*, CL4*a* and CL4*b* are formed in the ground pattern G2. The clearance regions CL3*a* and CL4*a* are positioned above the resonance pattern P2 constituting the band-pass filter 12*a*, and the clearance regions CL3*b* and CL4*b* are positioned above the resonance pattern P2 constituting the band-pass filter 12*b*.

Figure 10:
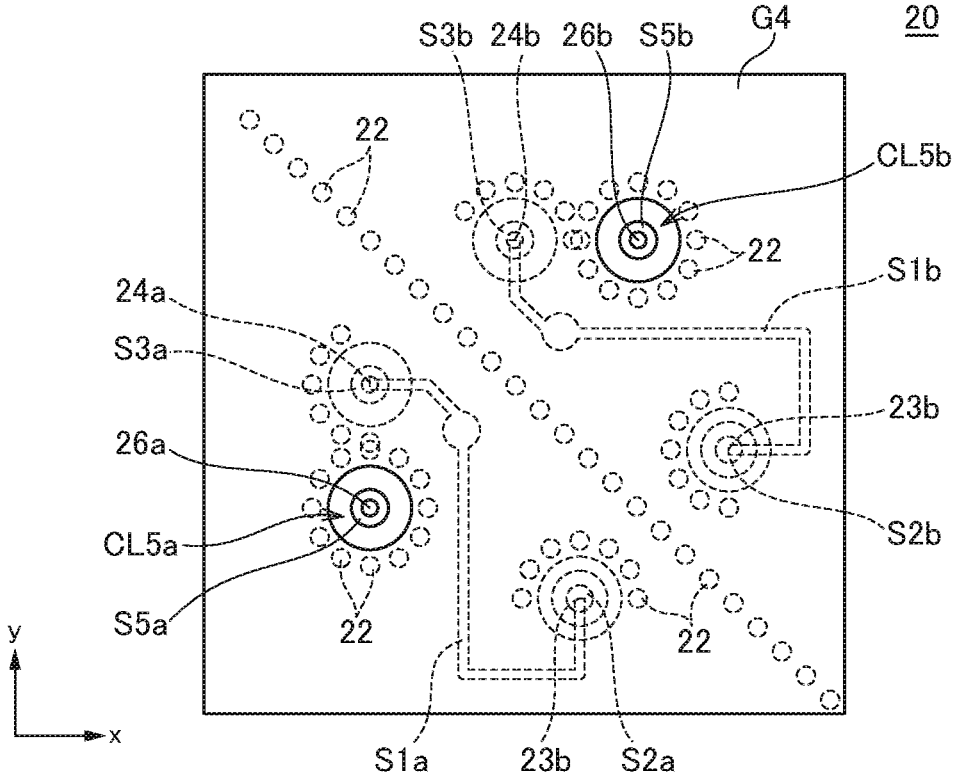
FIG. 10 is a schematic transparent plan view of the second circuit layer included in the dual-polarized antenna module as viewed from the upper surface side.
Figure 11:
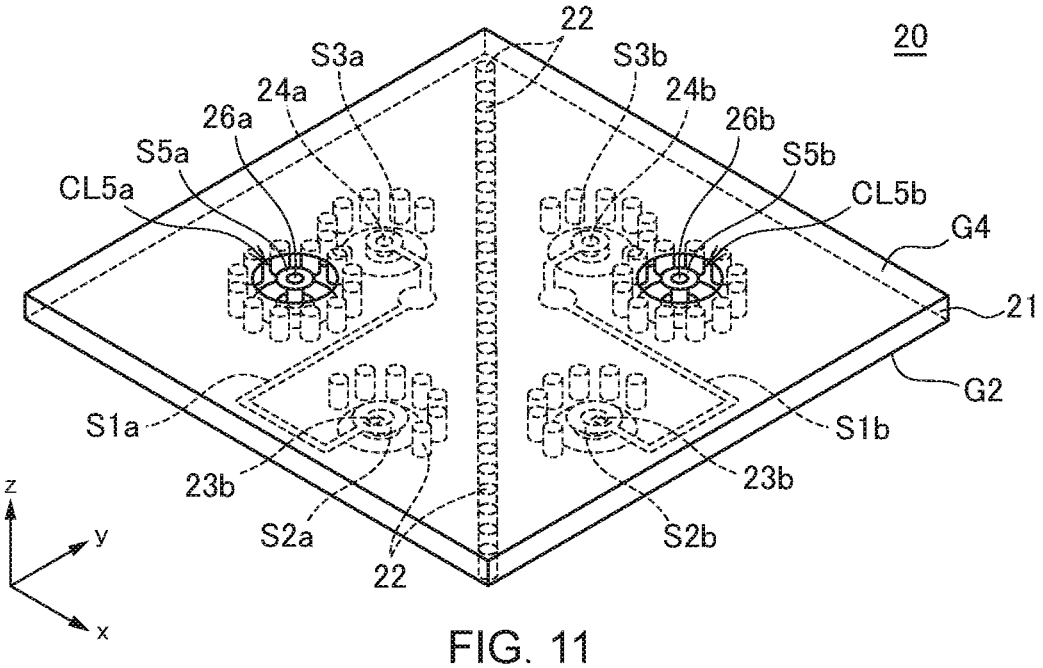
FIG. 11 is a schematic transparent perspective view of the second circuit layer included in the dual-polarized antenna module.

FIGS. 10 and 11 are a schematic transparent plan view and a schematic transparent perspective view, respectively, of the wiring layer 20 included in the dual-polarized antenna module 2 as viewed from the upper surface side.

As illustrated in FIGS. 10 and 11, the wiring layer 20 included in the dual-polarized antenna module 2 has two connection wirings S1*a* and S1*b*. One end of the connection wiring S1*a* is connected to the signal pattern S2*a* through a pillar conductor 23*a*, and the other end thereof is connected to a signal pattern S3*a* through a pillar conductor 24*a*. Similarly, one end of the connection wiring S1*b* is connected to the signal pattern S2*b* through a pillar conductor 23*b*, and the other end thereof is connected to a signal pattern S3*b* through a pillar conductor 24*b*.

The pillar conductor 24*a* is connected to one end of the resonance pattern P2 included in the band-pass filter 12*a*, and the pillar conductor 24*b* is connected to one end of the resonance pattern P2 included in the band-pass filter 12*b*. The other end of the resonance pattern Ps included in the band-pass filter 12*a* is connected to a signal pattern S5*a* through a pillar conductor 26*a*. The signal pattern S5*a* is disposed in a clearance region CL5*a* formed in the ground pattern G4. Similarly, the other end of the resonance pattern P2 included in the band-pass filter 12*b* is connected to a signal pattern S5*b* through a pillar conductor 26*b*. The signal pattern S5*b* is disposed in a clearance region CL5*b* formed in the ground pattern G4.

A plurality of pillar conductors 22 are disposed around each of the clearance regions CL2*a* to CL5*a* and CL2*b* to CL5*b*, whereby a ground potential is stabilized. Further, the plurality of pillar conductors 22 are arranged in the diagonal direction, whereby isolation between a horizontal polarization signal and a vertical polarization signal is enhanced.

Figure 12:
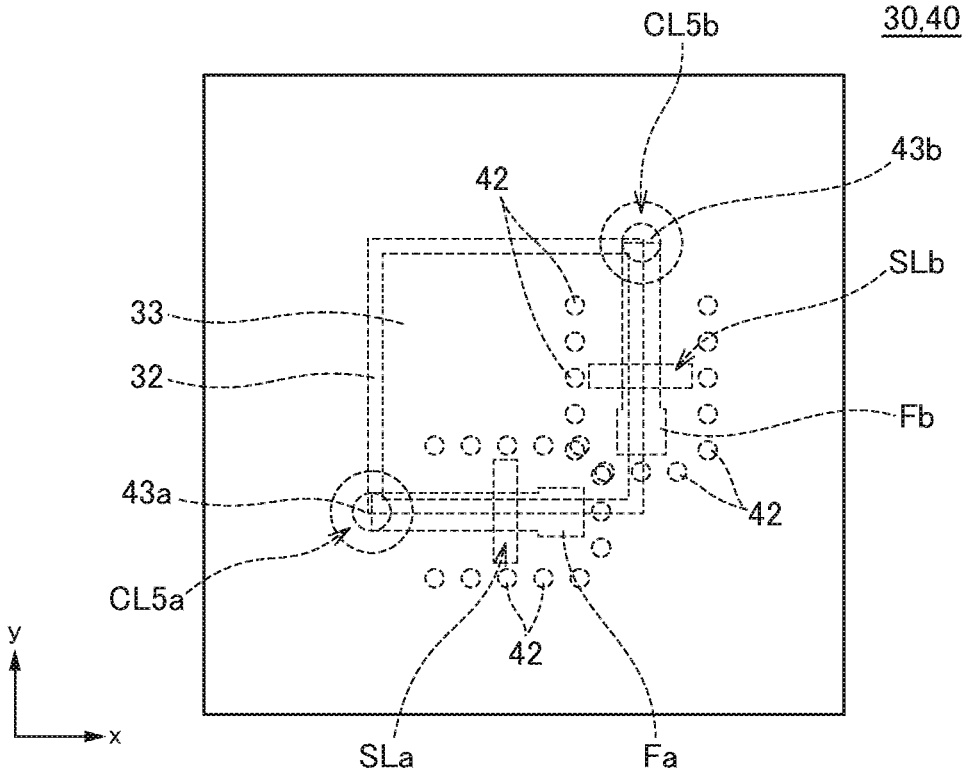
FIG. 12 is a schematic transparent plan view of the feed layer and the antenna layer included in the dual-polarized antenna module as viewed from the upper surface side.
Figure 13:
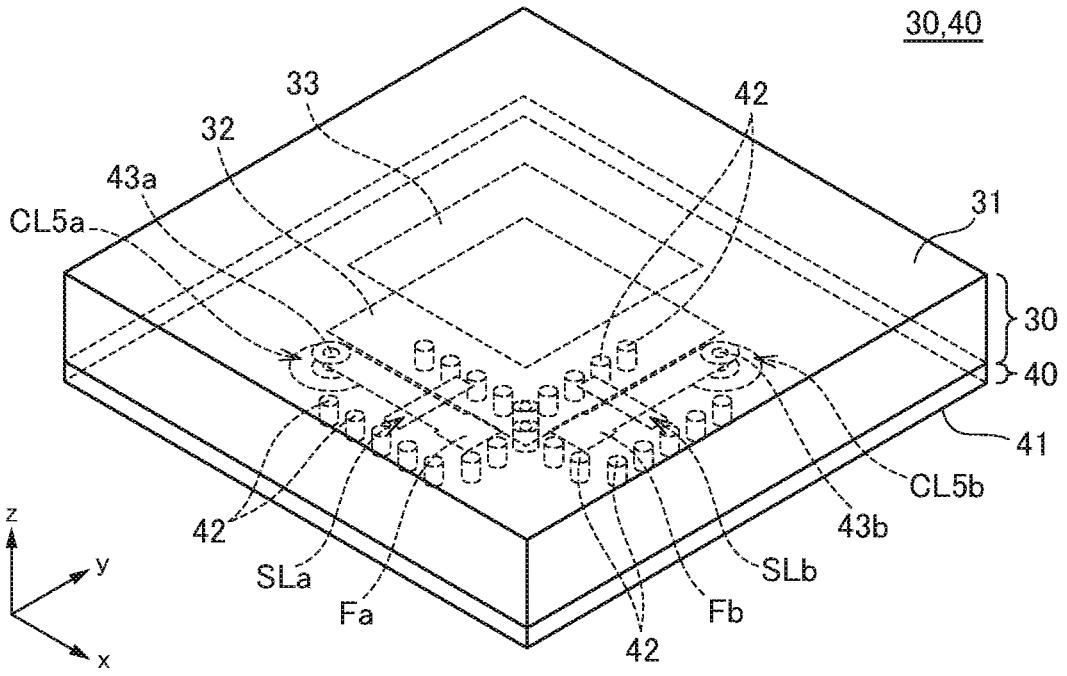
FIG. 13 is a schematic transparent perspective view of the feed layer and the antenna layer included in the dual-polarized antenna module.
Figure 14:
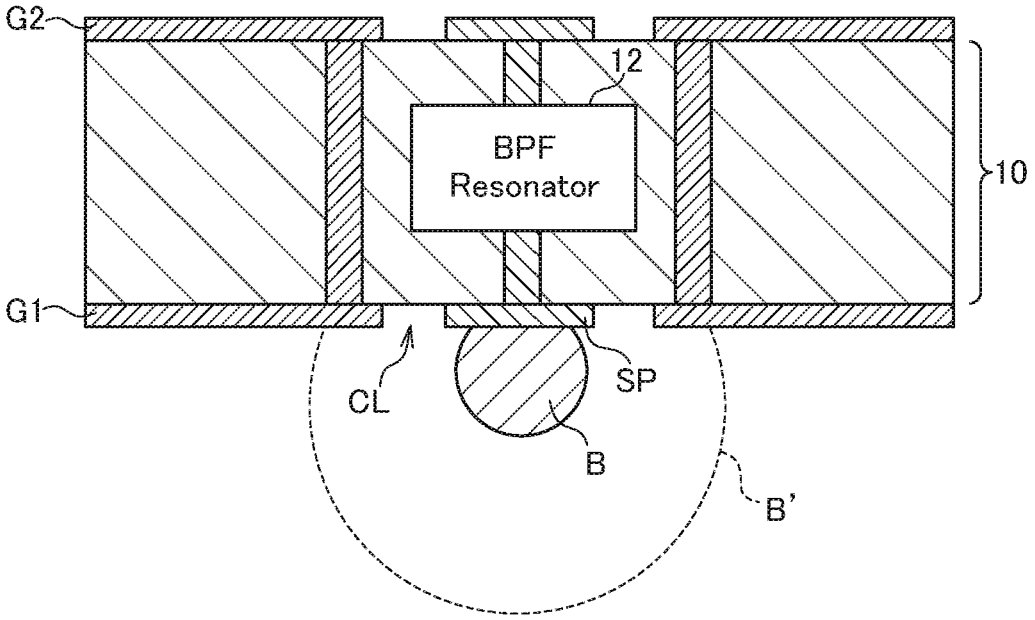
PRIOR ART FIG. 14
FIG. 14 is a schematic diagram for explaining a first prior art.
Figure 15:
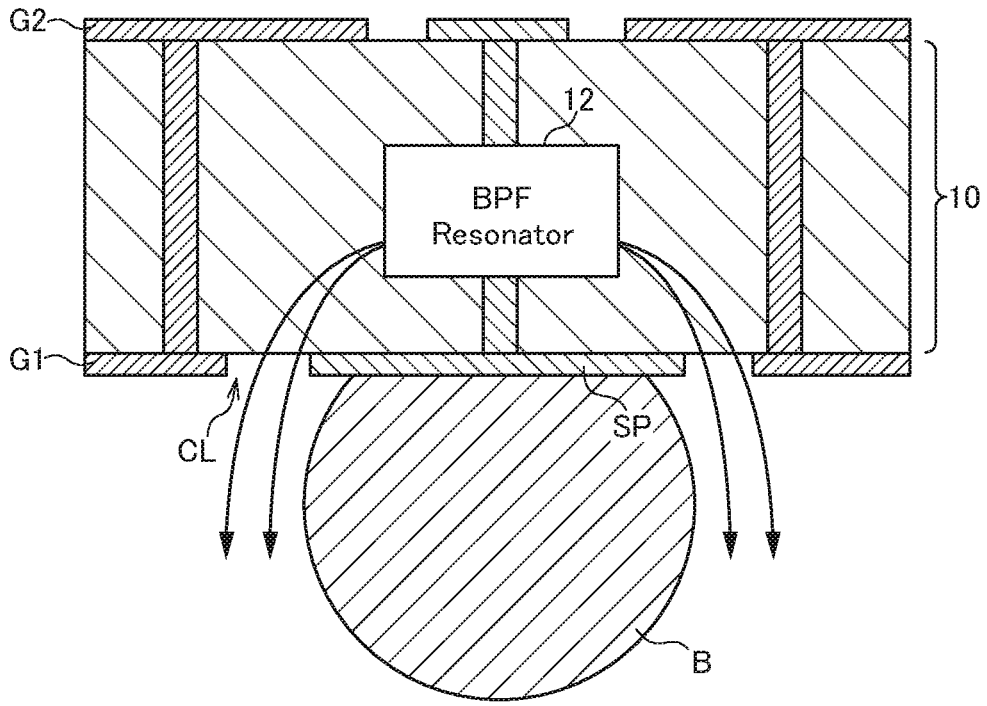
PRIOR ART FIG. 15
FIG. 15 is a schematic diagram for explaining a second prior art.
Figure 16:
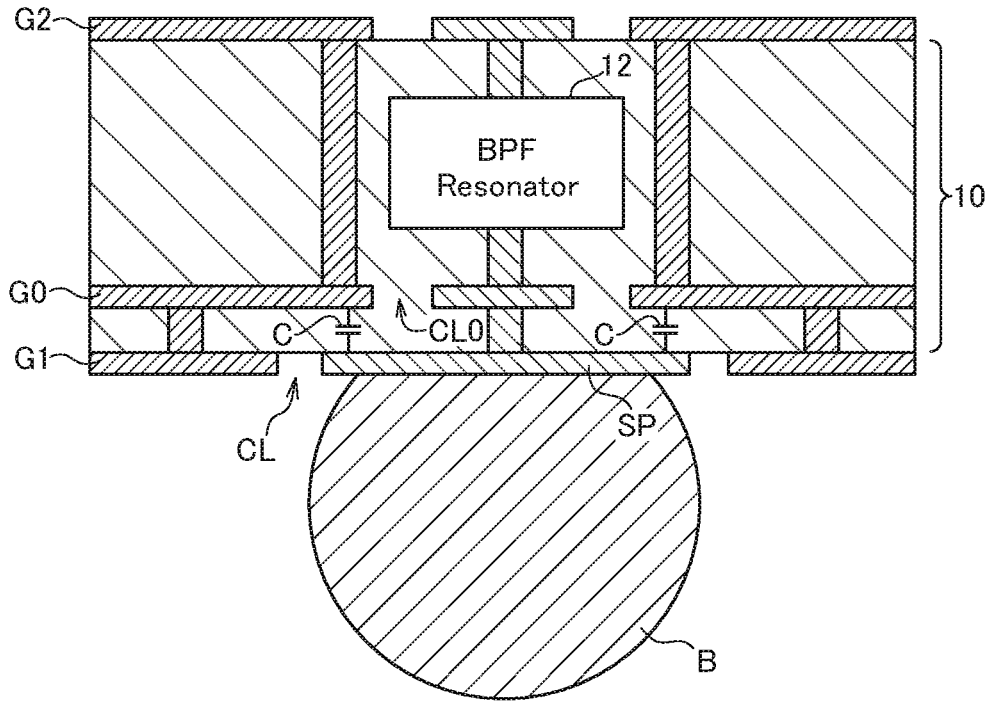
PRIOR ART FIG. 16
FIG. 16 is a schematic diagram for explaining a third prior art.

FIGS. 12 and 13 are a schematic transparent plan view and a schematic transparent perspective view, respectively, of the feed layer 40 and the antenna layer 30 included in the dual-polarized antenna module 2 as viewed from the upper surface side.

As illustrated in FIGS. 12 and 13, the feed layer 40 included in the dual-polarized antenna module 2 has two feed patterns Fa and Fb. One end of the feed pattern Fa is connected to the band-pass filter 12*a* through a pillar conductor 43*a*, and one end of the feed pattern Fb is connected to the band-pass filter 12*b* through a pillar conductor 43*b*. The feed pattern Fa extends in the x-direction, and the feed pattern Fb extends in the y-direction. Two slots SLa and SLb are formed in the ground pattern G3. The slot SLa extends in the y-direction so as to cross the feed pattern Fa in a plan view, and the slot SLb extends in the x-direction so as to cross the feed pattern Fb in a plan view.

As a result, a vertical polarization signal is fed from the feed pattern Fa through the slot SLa to the center position of the side (lower side in FIG. 12) of the radiation conductor that extends in the x-direction, and a horizontal polarization signal is fed from the feed pattern Fb through the slot SLb to the center position of the side (right side in FIG. 12) of the radiation conductor 32 that extends in the y-direction. Thus, the antenna module 2 according to the present embodiment can be used as a dual-polarized antenna module.

When the antenna module 2 according to the present embodiment is used as a dual-polarized antenna module, the number of patterns to be formed in each of the circuit layer 10, wiring layer 20 and feed layer 40 is approximately doubled. However, in the antenna module 2 according to the present embodiment, the wiring layer 20 and the feed layer 40 are laminated together, thus making it possible to adopt a layout in which the connection wirings S1*a* and S1*b* cross the feed patterns Fa and Fb, respectively.

It is apparent that the present invention is not limited to the above embodiments, but may be modified and changed without departing from the scope and spirit of the invention.

What is claimed is:

1. An antenna module comprising:

a circuit layer having a filter circuit;

an antenna layer laminated on the circuit layer and having a radiation conductor;

a wiring layer positioned between the circuit layer and the antenna layer and having a connection wiring connected to the filter circuit;

a first ground pattern provided on a surface of the circuit layer located on an opposite side of the wiring layer;

a second ground pattern provided between the circuit layer and the wiring layer;

a third ground pattern provided between the wiring layer and the antenna layer; and a signal terminal provided on the surface of the circuit layer and positioned within a clearance region where the first ground pattern is cut away, wherein the clearance region is located so as not to overlap the filter circuit as viewed in a lamination direction, wherein the signal terminal is connected to the filter circuit through a pillar conductor penetrating the circuit layer and the connection wiring, and wherein the radiation conductor receives power through a feed pattern connected to the filter circuit.

2. The antenna module as claimed in claim 1, wherein a diameter of the clearance region is equal to or larger than 1/10 of a wavelength of an antenna signal radiated from the radiation conductor in the circuit layer.

3. The antenna module as claimed in claim 1, wherein a dielectric constant of a dielectric constituting the wiring layer is lower than a dielectric constant of a dielectric constituting the circuit layer.

4. The antenna module as claimed in claim 3, wherein the dielectric constant of the dielectric constituting the wiring layer is substantially equal to a dielectric constant of a dielectric constituting the antenna layer.

5. The antenna module as claimed in claim 1, wherein the feed pattern is electromagnetically coupled to the radiation conductor through a slot formed in the third ground pattern.

6. The antenna module as claimed in claim 5, wherein the feed pattern is formed in the wiring layer.

7. The antenna module as claimed in claim 5, further comprising:

a feed layer provided between the wiring layer and the antenna layer and having the feed pattern; and a fourth ground pattern provided between the wiring layer and the feed layer, wherein the third ground pattern is provided between the feed layer and the antenna layer.

8. The antenna module as claimed in claim 1, wherein the filter circuit includes a band-pass filter.

9. The antenna module as claimed in claim 1, wherein the antenna layer further has another radiation conductor that overlaps the radiation conductor as viewed in the lamination direction.

10. The antenna module as claimed in claim 1, wherein a plurality of the radiation conductors are arranged in an array.

11. An apparatus comprising:

a first conductive layer having a first ground pattern and a first signal pattern located in a first clearance region free from the first ground pattern;

a second conductive layer having a second ground pattern, a second signal pattern located in a second clearance region free from the second ground pattern, and a third signal pattern located in a third clearance region free from the second ground pattern;

a third conductive layer having a third ground pattern;

a first dielectric layer located between the first and second conductive layers;

a second dielectric layer located between the second and third conductive layers;

a first connection conductor formed in the first dielectric layer to connect the first signal pattern to the second signal pattern;

a second connection conductor formed in the second dielectric layer to connect the second signal pattern to the third signal pattern; and a filter circuit formed in the first dielectric layer and connected to the third signal pattern.

12. The apparatus as claimed in claim 11, wherein the first signal pattern is greater in area than the second signal pattern.

13. The apparatus as claimed in claim 11, wherein the first and second signal patterns are located so as not to overlap the filter circuit, and wherein the third signal pattern is located so as to overlap the filter circuit.

14. The apparatus as claimed in claim 11, further comprising a third connection conductor formed in the first dielectric layer to connect the first ground pattern to the filter circuit.

15. The apparatus as claimed in claim 14, further comprising a fourth connection conductor formed in the first dielectric layer to connect the second ground pattern to the filter circuit.

16. The apparatus as claimed in claim 15, further comprising a fifth connection conductor formed in the first dielectric layer to connect the first ground pattern to the second ground pattern.

17. The apparatus as claimed in claim 11, wherein the second conductive layer further has a fourth signal pattern located in a fourth clearance region free from the second ground pattern, and wherein the filter circuit is connected between the third and fourth signal patterns.

18. The apparatus as claimed in claim 17, further comprising:

a third dielectric layer laminated on the second dielectric layer such that the third ground pattern is located between the second and third dielectric layers;

a radiation conductor formed in the third dielectric layer; and a feed pattern formed in the second dielectric layer, wherein the feed pattern is connected to the fourth signal pattern, and wherein the third ground pattern has a slot that overlaps each of the feed pattern and the radiation conductor.

* * * * *